United States Patent [19]

Healy et al.

[11] Patent Number: 4,882,889

[45] Date of Patent: Nov. 28, 1989

[54] COMPOSITE STRUCTURES

[75] Inventors: Christopher L. Healy, Seven Hills; Ken Rankin, Kellyville, both of Australia

[73] Assignee: Monier Limited, Australia

[21] Appl. No.: 161,025

[22] Filed: Feb. 26, 1988

[30] Foreign Application Priority Data

Feb. 26, 1987 [AU] Australia ..... P10550

[51] Int. Cl.[4] ..... E04B 5/40

[52] U.S. Cl. ..... 52/336; 52/332; 52/450; 52/630

[58] Field of Search ..... 52/332–338, 52/450–453, 630

[56] References Cited

U.S. PATENT DOCUMENTS

| | | | |
|---|---|---|---|
| 1,791,881 | 2/1931 | Yarwood | 52/336 X |
| 3,555,762 | 1/1971 | Costanzo, Jr. . | |
| 3,557,511 | 1/1971 | Curran . | |
| 3,608,267 | 9/1971 | Curran | 52/332 |
| 3,792,560 | 2/1974 | Naylor | 52/450 X |

FOREIGN PATENT DOCUMENTS

| | | | |
|---|---|---|---|
| 2106376 | 11/1971 | Fed. Rep. of Germany | 52/335 |
| 2339638 | 2/1975 | Fed. Rep. of Germany | 52/336 |
| 8402734 | 7/1984 | PCT Int'l Appl. . | |
| 1026091 | 4/1966 | United Kingdom . | |
| 1094581 | 12/1967 | United Kingdom . | |
| 1266923 | 3/1972 | United Kingdom . | |
| 1333453 | 10/1973 | United Kingdom . | |
| 1361448 | 7/1974 | United Kingdom . | |
| 1502133 | 2/1978 | United Kingdom . | |
| 1585471 | 3/1981 | United Kingdom . | |
| 2154626 | 9/1985 | United Kingdom . | |
| 2176821 | 1/1987 | United Kingdom . | |

*Primary Examiner*—Richard E. Chilcot, Jr.
*Attorney, Agent, or Firm*—Stevens, Davis, Miller & Mosher

[57] ABSTRACT

A composite structure comprising a plurality of support members (11) arranged to form a decking member within a slab (15) said support members (11) comprising a pair of flange members (13, 14) joined by connecting a connecting web member (12), at least one flange member (11) having a lip portion.

A support member (11) comprising a pair of flange members (13, 14) joined by a connecting web member (12), at least one flange member having a lip portion, said lip portion comprising a ridge member and depending stepped portion.

13 Claims, 3 Drawing Sheets

COMPOSITE STRUCTURES

FIELD OF THE INVENTION

This invention relates to composite structures particularly, slabs and steel decking used therein.

BACKGROUND ART

Composite structures comprising steel decking and concrete are well known in the building trade and have wide application within the trade. However, the performance of the composite structure depends on the efficiency of the connection between the concrete and the steel deck.

The conventional approaches to composite floor decking the contribution of the metal decking to the strength of the final structure relies on the bond which is formed between the concrete and the galvanised surface of the decking and its flanges. Under excess load this bond deteriorates progressively along the length of the decking, with a marked loss of strength and ultimately failure of the decking.

SUMMARY OF THE INVENTION

The present invention employs a plurality of support members each support member defined by a pair of flange members joined by a connecting web, each flange member incorporating a lip portion, at least one lip portion having a plurality of apertures to achieve a positive locking of the support within the concrete thereby reducing the slip between support member and the slab and increasing load capacity.

As the support member is more efficiently utilised that in prior art composite structures, thinner slabs for the same load capacity or greater load capacity for the same overall thickness can be obtained.

In accordance with the present invention there is provided a composite structure comprising a plurality of support members arranged to form a decking member within a slab said support members comprising a pair of flange members joined by a connecting web member, at least one flange member having a lip portion.

The support members are usually placed in parallel and one lip portion preferably overlaps the adjacent flange member or adjacent lip portion, allowing a slight overhang of the lip portion or no overhang at all. The lip portion may rest on the adjacent flange member or lip portion but this aspect is not essential.

In a preferred form, at least one lip portion includes a plurality of apertures along the length of the lip portion. When only one lip portion has apetures it is preferable to have a slight overhang in order that when the slab is poured, the slab sets through the apetures to provide improved locking of the decking within the slab and decreasing lateral movement. When the support members each have opposing lip portions the lip portion of one member may overlap the adjacent lip portion of an adjacent flange member. If both lip portions have apetures it is preferable for the apetures of the overlapping lip portion to correspond to the apetures of the lip portion underneath. In that situation, the slab sets through the two sets of apetures allowing improved locking of the decking within the slab and decreasing lateral movement.

Any one or all of the flanges may incorporate one or more grooves along the length of the support members. The grooves may be of any suitable configuration or direction but the most preferred grooves run the length of the flange and are substantially parallel to one another. The grooves aid locking of the decking within the slab and act as locating means for supported structures.

The present invention reduces the chance of failure of the decking because reliance is not placed solely on the bond formed between the slab and the surface of the decking. The present invention provides alternative and additional means or support of the decking within the slab.

BRIEF DESCRIPTION OF THE DRAWINGS

The present invention will now be described by way of example in accordance with the following drawings in which.

Figure 1:
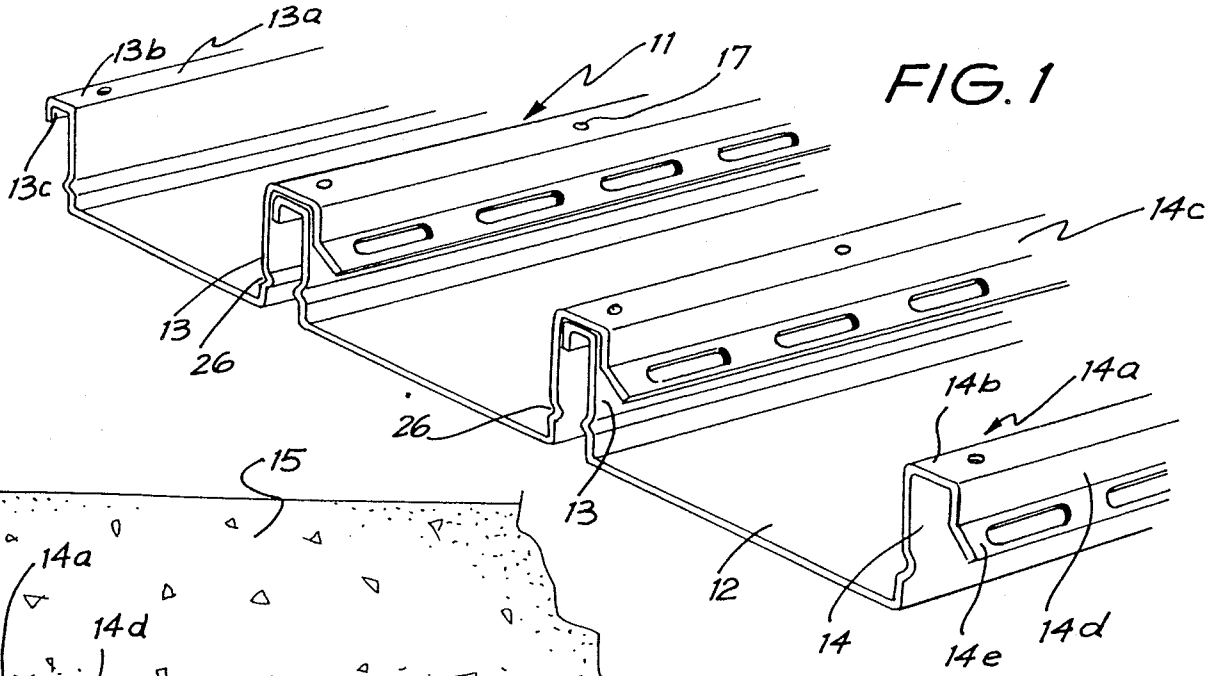
FIG. 1 is a perspective view of a plurality of supports according to one embodiment of the present invention.

The support 11 is substantially U-shaped in cross-section comprising a web 12, flanges 13 and 14 and corresponding lips 13*a*, and 14*a*.

Lip 13*a* comprises a ridge 13*b* having a depending portion 13*c*. The ridge 13*b* is substantially perpendicular to both the flange 13 and the portion 13*c* while the portion 13*c* and flange 13 are substantially parallel.

Lip 14*a* comprises a ridge 14*b* and depending stepped portion 14*c*. The portion 14*c* includes a depending portion 14*d* and angled skirt 14*e*. Apetures 16 are evenly spaced along the length of the skirt 14*e* and allow positive locking of the support 11 within the slab 15.

The flanges 13 and 14 include equally opposing grooves 26 located near the edge of the flanges 13 and 14 and the web 12. The grooves 26 assist in the reduction of lateral movement of the supports within the composite slab 15 and also act as locating means for supported structure such as suspended ceilings.

In use, a plurality of supports 11 are positioned together to form a decking and in such a manner that lip 13*a* of one support is located within lip 14*a* of a second support.

Figure 2:
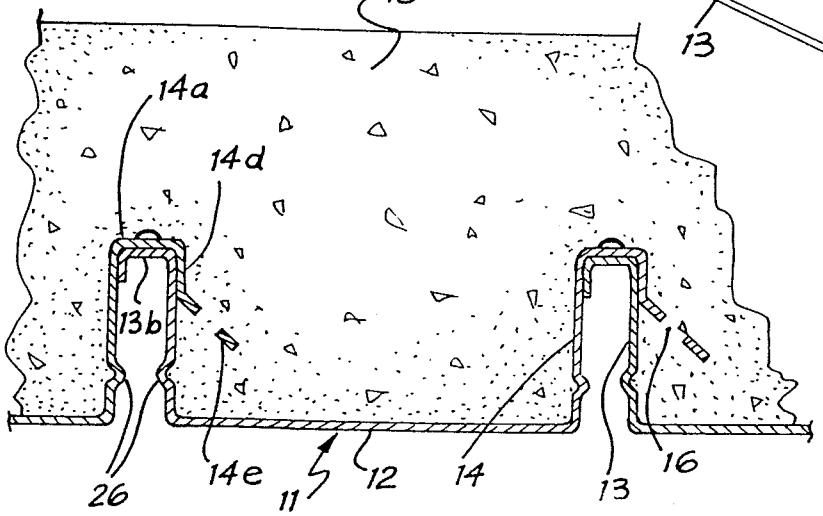
FIG. 2 is a sectional end view of a plurality of supports, in accordance with FIG. 1, secured in a concrete slab.
Figure 3:
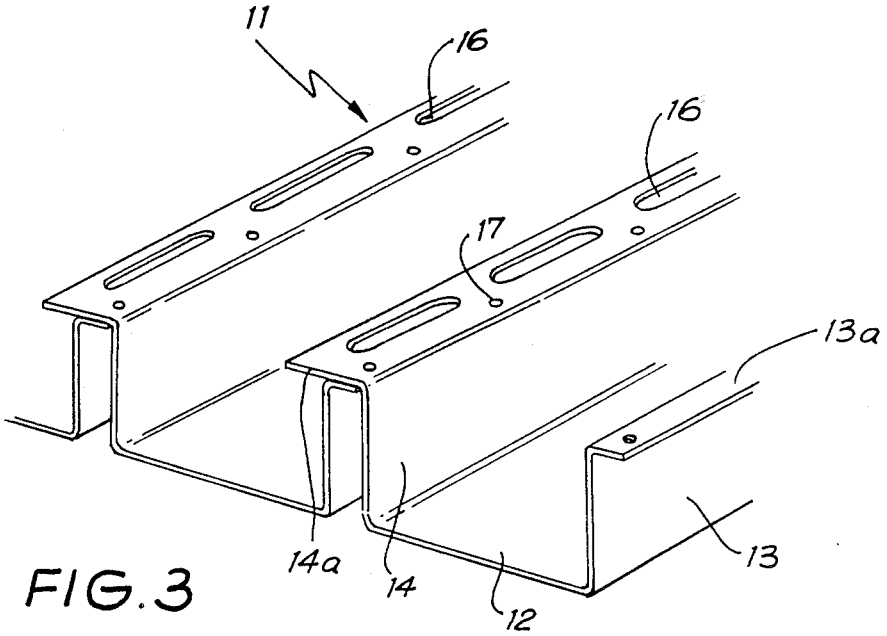
FIG. 3 is a perspective view of a plurality of supports according to a second embodiment of the present invention.
Figure 4:
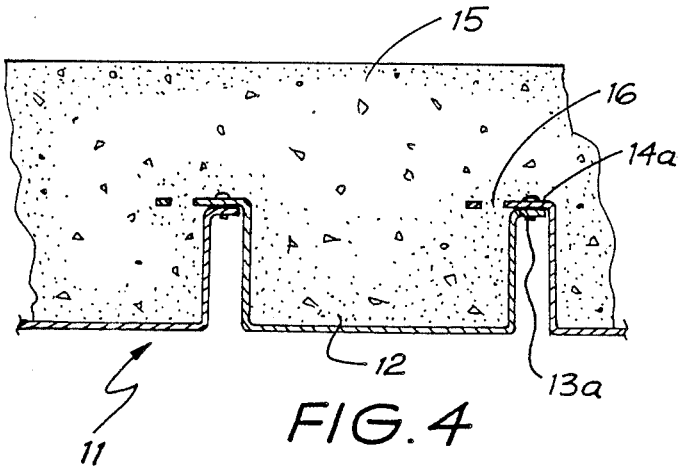
FIG. 4 is a sectional end view of a plurality of supports, in accordance with FIG. 3, secured in a concrete slab.

Skirt 14*e* may or may not be angled, as the situation demands, but experimentation has indicated that angling of skirt 14*e* assists location of lip 13*a* within lip 14*a*. Further, as can be seen in FIG. 2, angling of skirt 14*e* allows the slab 15 to set through apeture 16 and further reduce unnecessary or unwanted lateral movement within the slab 15.

The number of supports used is dependent upon the length of the composite slab 15 required but usually the supports are positioned throughout the length of the slab 15.

Each lip 14*c* has a plurality of apertures 16 evenly spaced throughout the length of the support. In FIG. 2 the apertures 16 are punched in such a way that they wholly extend beyond the underlying lip 13*a*.

In a preferred embodiment, successive supports 11 are secured together by bolts or tap screws 17 driven through lips 14*a* and 13*a*. The bolts or screws 17 are vertically spaced along the lips 14*a* and 13*a* positioned to provide the most secure connection between the lips 13*a* and 14*a*.

Figure 5:
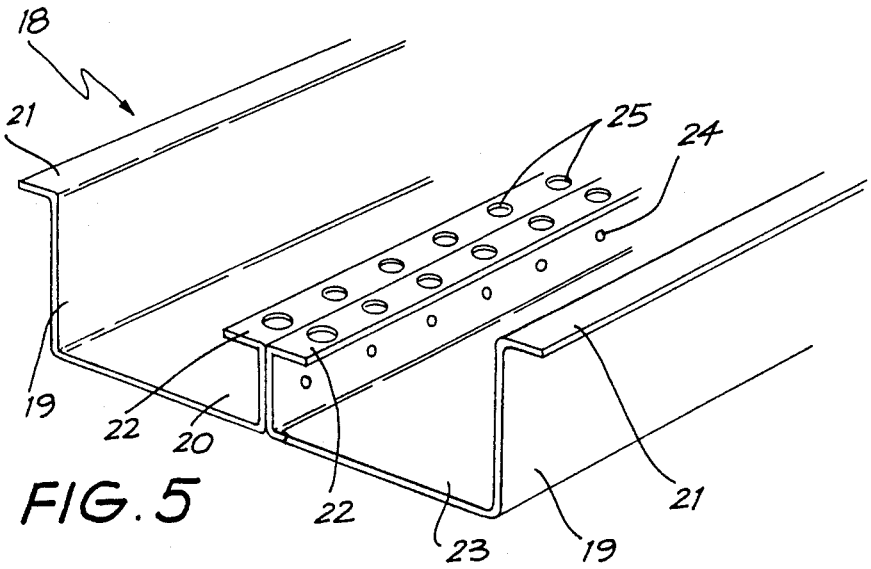
FIG. 5 is a perspective view of a support according to a third embodiment of the present invention.
Figure 6:
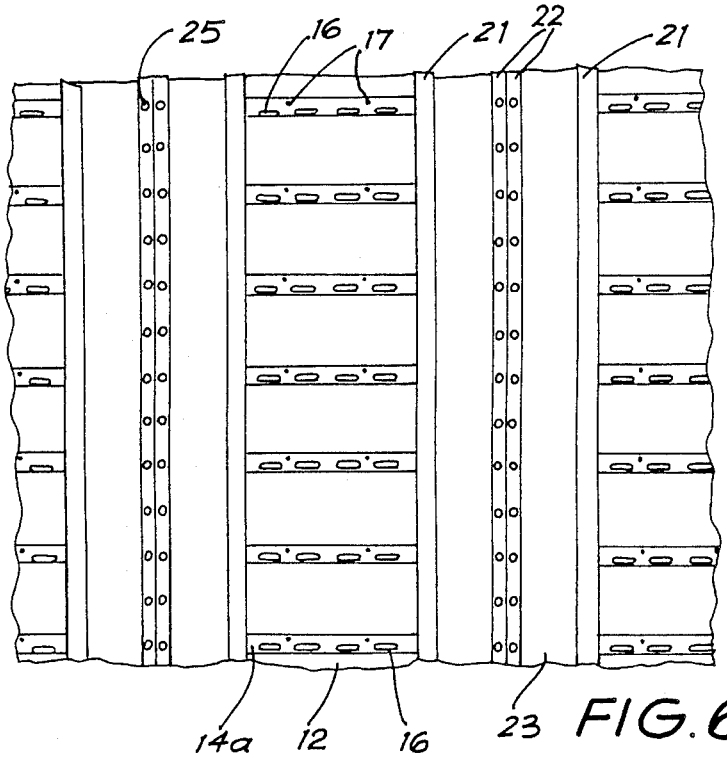
FIG. 6 is a sectional plan view of two separate embodiments of a support according to the present invention.

It is also envisaged that the composite slab may be further reinforced by the inclusion of supports as shown in FIGS. 5 and 6. The support 18 comprises flanges 19 and 20 having lips 21 and 22, said flanges 19 and 20 joined by an interconnecting web 23. In use, two supports 18 are secured together along the outer faces of the respective flanges 20, those flanges 20 and the supports 18 secured together by bolts 24, the bolts 24 being horizontally spaced along the length of the support. Each lip 22 has a plurality of apertures 25 evenly spaced throughout the length of the support 18. As in the earlier embodiment, the apertures 25 economise on metal in the total support dimensions and are not essential features of the invention. However, the row of apertures does assist in positive locking of the support 18 within the concrete slab.

Respective lips 22 splay in opposite directions to each other but in the same direction as corresponding lips 21. Such formation of the lips 22 allows the outer face of the flanges 20 to be positioned flush to one another. The lips 21 also splay in opposite directions to one another. In this particular embodiment, the lips 21 and 22 are slightly curved in cross-section although this is not an essential feature of the lips 21 and 22.

The individual supports 18 are substantially Z-shaped in cross-section.

In use, a plurality of supports 18 may be positioned, and secured within the slab, perpendicularly to a plurality of supports 11. The supports 18 may be located at either end of the concrete slab and at spaced intervals along the length of the concrete slab. In this embodiment the supports 18 act as reinforcing members for the supports 11 and the concrete slab as a whole. The supports 18 may also act as support for a further layer of supports 11 within the concrete slab.

Various modifications may be made in details of design and construction without departing from the scope and ambit of the invention.

We claim:

1. A composite structure comprising a plurality of support members arranged to form a decking member within a concrete slab, said support members comprising a pair of flange members joined by an imperforate connecting web member, at least one flange member located above said web member, said flange member including a lip portion having a plurality of apertures positioned so that part of the concrete of the slab is retained within the apertures by the web member during setting of the concrete.

2. A composite structure comprising a plurality of support members arranged to form a decking member within a slab, said support members comprising a pair of flange members joined by a connecting web member, at least one flange member including a lip portion having a plurality of apertures.

3. A composite structure in accordance with claim 2 wherein the support members are in parallel.

4. A composite structure in accordance with claim 3 wherein a lip portion of a first support member engages a flange member or a lip portion of a second support member.

5. A composite structure in accordance with claim 3 wherein at least one flange member has a longitudinal groove means.

6. A composite structure in accordance with claim 3 wherein reinforcing members are positioned at spaced intervals along the length of the slab and at either end of the slab.

7. A composite structure in accordance with claim 2 wherein a lip portion of a first support member engages a flange member or a lip portion of a second support member.

8. A composite structure in accordance with claim 7 wherein a lip portion of a first support member overlaps a flange member of a second support member.

9. A composite structure in accordance with claim 7 wherein a lip portion of a first support member overlaps a lip portion of a second support member.

10. A composite structure in accordance with claim 2 wherein at least one flange member has a longitudinal groove means.

11. A composite structure in accordance with claim 2 wherein reinforcing members are positioned at spaced intervals along the length of the slab and at either end of the slab.

12. A support member comprising a pair of flange members joined by a connecting web member, said at least one flange member having a lip portion comprising a ridge member and dependent stepped portion, said stepped portion including a dependent skirt having a plurality of apertures therein.

13. A support member in accordance with claim 12 wherein at least one flange member incorporates a longitudinal groove means.

* * * * *